US006321822B1

(12) United States Patent
Horner et al.

(10) Patent No.: US 6,321,822 B1
(45) **Date of Patent: *Nov. 27, 2001**

(54) RELEASE MECHANISM FOR INDUSTRIAL DOORS

(75) Inventors: Bill Horner; Tom Jansen, both of Dubuque, IA (US); Perry Knutson, Lancaster, WI (US); Steve Lester, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/541,830

(22) Filed: Apr. 3, 2000

Related U.S. Application Data

(63) Continuation of application No. 09/280,343, filed on Mar. 29, 1999, which is a continuation of application No. 08/654,500, filed on May 28, 1996, now Pat. No. 5,887,385.

(51) Int. Cl.[7] ..... E05D 15/06

(52) U.S. Cl. ..... 160/194; 160/201; 16/96 R; 49/197

(58) Field of Search ..... 49/197, 199, 200, 49/453, 454, 455, 428; 160/194, 195, 274, 272, 273.1, 270; 16/94 R, 96 R

(56) References Cited

U.S. PATENT DOCUMENTS

| | | | |
|---|---|---|---|
| 2,134,397 | 10/1938 | Clark . | |
| 2,641,031 | 6/1953 | Ehret | 49/199 |
| 2,786,523 | 3/1957 | Phillips . | |
| 2,839,135 | 6/1958 | Anderson | 160/133 |
| 3,484,812 | 12/1969 | Holland | 160/201 |
| 4,016,920 | 4/1977 | Shepard | 160/201 |
| 4,241,540 | 12/1980 | Depperman | 49/199 |
| 4,269,253 | 5/1981 | Ziegler . | |
| 4,478,268 | 10/1984 | Palmer | 160/310 |
| 4,572,268 | 2/1986 | Wentzel | 160/201 |
| 4,676,293 | 6/1987 | Hanssen . | |

(List continued on next page.)

FOREIGN PATENT DOCUMENTS

WO 95/19486 7/1995 (WO) .

OTHER PUBLICATIONS

Brochure: TKO™ The Knock Out Dock Door; date unknown; HPD International, Inc.
Brochure: Super Seal Searies 6500 Breakaway Panel Competitive Analysis; Apr. 1996; SuperSeal Mfg. Ltd.
Brochure: Atmodoor Environmental Control Doors; Apr. 1995; SuperSeal Mfg. Ltd.
Brochure: EnviroDor SRS Section Release System; date unknown; EnviroDor, Inc.
Brochure: JETROLL™ Ultra High Speed Traffic Door; Oct. 1995; Copyright 1995 Overhead Door Corporation.
Brochure : JETSET™ Breakaway Bottom Bar For The JETROLL Door; Oct. 1995; Copyright 1995 Overhead Door Corporation.

*Primary Examiner*—Curtis A. Cohen
(74) *Attorney, Agent, or Firm*—Marshall, Gerstein & Borun

(57) ABSTRACT

A release mechanism for use in combination with an industrial door, which includes an extension member extending across the doorway opening when the door is in its doorway-blocking positions, the releasing mechanism including a roller mounted for movement with the extension member, and a track including a guideway for receiving the roller and guiding it during normal door operation, the roller and track being movable relative to each other upon application of a breakaway force to the extension member, thereby allowing the roller to escape from the track when a breakaway force is applied to the extension member, the breakaway force being defined as a force that has a component perpendicular to the plane of the door above a certain magnitude.

7 Claims, 9 Drawing Sheets

U.S. PATENT DOCUMENTS

| | | | | |
|---|---|---|---|---|
| 4,726,148 | | 2/1988 | Tix | 49/453 |
| 4,993,188 | * | 2/1991 | Erickson et al. | 49/419 |
| 5,141,043 | | 8/1992 | Kraeutler | 160/267.1 |
| 5,210,015 | | 5/1993 | Kraeutler | 160/271 |
| 5,219,015 | | 6/1993 | Kraeutler . | |
| 5,414,962 | * | 5/1995 | Forbis et al. | 49/454 |
| 5,526,865 | | 6/1996 | Coenraets | 160/272 |
| 5,535,805 | | 7/1996 | Kellogg et al. . | |
| 5,562,141 | | 10/1996 | Mullet et al. . | |
| 5,584,333 | | 12/1996 | Torchetti et al. . | |
| 5,601,133 | | 2/1997 | Krupke et al. . | |
| 5,632,317 | | 5/1997 | Krupke et al. . | |
| 5,829,504 | | 11/1998 | Ekstrand et al. | 160/201 |
| 5,878,803 | | 3/1999 | Kraeutler | 160/271 |
| 5,887,385 | * | 3/1999 | Horner et al. | 160/201 |

* cited by examiner 12
26
20
28
48
50
46
W
D 12
28
20
48
50
26
46
W
D 12
28
20
48
50
26
46
W
D

RELEASE MECHANISM FOR INDUSTRIAL DOORS

This is a Continuation of U.S. application Ser. No. 09/280,343, filed Mar. 29, 1999 which is a Continuation of U.S. application Ser. No. 08/654,500, filed May 28, 1996, now U.S. Pat. No. 5,887,385.

FIELD OF THE INVENTION

The invention is directed generally to industrial doors, and more specifically to a release mechanism for allowing an industrial door to break away from its associated guide track upon an applied force above a certain magnitude.

BACKGROUND OF THE INVENTION

A wide variety of doors are used in industrial settings. Such industrial doors include conventional sectional doors, comprising a series of panels hinged together to form the door. Typically, such a sectional door is movable between doorway-blocking positions and overhead-storing positions. For this purpose, a curved guide track is disposed on either side of the doorway, with one leg (adjacent to the doorway opening) extending vertically along the doorway, and the second leg (projecting back from the doorway opening) disposed above and behind the doorway. A curved track section joins the two legs. Sectional doors may also be vertically stored, that is they may have straight tracks and be movable in a continuous plane between doorway-blocking and doorway-opening positions. Typically, the panels comprising such a sectional door are formed of either metal or wood.

In other types of industrial doors, the door itself may be formed of fabric. One such type of fabric industrial door is a roll-up door, in which the door is a curtain of fabric rolled on a roller tube typically disposed above the doorway opening. To close the door, the curtain is drawn off of the roller, and the roller is reversed to roll the curtain up on the roller for the purpose of opening the door. Another type of fabric industrial door is a so-called "concertina" door. In a concertina door, the door typically also comprises a fabric curtain and a roller is disposed above the doorway opening. Straps are wound onto and off of the roller, and are connected typically to a leading edge of the curtain for the purpose of drawing the curtain up out of the way of the door opening, and allowing the curtain to fall and unfold to cover the door opening. The curtain itself does not wind on the tube, however, and rather is gathered in folds at the top of the door. A still further type of fabric industrial door is a sheet of fabric that is maintained in a flat orientation, and is moved between a doorway-blocking and a doorway-opening position. The doorway opening position may either be above the doorway or overhead, similar to an overhead-style sectional door. Further, while all of these doors have been described as moving vertically, they may also be modified such that their movement between door opening and door closing positions is in a horizontal or other direction, as opposed to a vertical direction Roll-up doors comprising metal or chain sections are also known.

All of the industrial doors just described typically share a common feature of having a member extending across the doorway opening when the doorway is either in the closed or any of a variety of doorway-blocking positions. Such structure will be referred to herein as an "extension member." In sectional doors, the extension members are the door panels themselves. Fabric doors typically include either a relatively rigid bottom bar extending across the leading edge of the door, and/or other relatively rigid bars extending across the width of the door at locations other than at the leading edge (these are often referred to as "wind bars" as they assist in adding stability to the door and preventing it from billowing under wind load conditions).

A common problem associated with such doors as a result of the presence of these extension members extending across the doorway is unintentional impact. In an industrial or warehouse setting, such impact may occur by virtue of a fork lift or other material handling equipment (or a load carried thereon) being driven into the door and the impact is thus directly or indirectly transmitted to the extension members. In situations where such doors are used in automated factories, conveyors or other devices may cause objects being conveyed to accidentally impact the doors. Given the fact that such impacts are bound to occur, certain types of industrial doors can be designed to withstand such impacts. For example, the panels comprising a sectional door, and the associated track and hardware can be reinforced to withstand such impacts. Of course, this adds significant expense to the door. Further, fabric-type industrial doors typically do not have this option as the door itself is formed of fabric which is more easily damaged than the metal or wood typically comprising sectional doors.

Accordingly, another solution to allowing industrial doors to withstand impact is to allow them to have a controlled breakaway under such an impact. That is, the door is designed for certain components to separate upon an unintentional impact, thus protecting the remainder of the door. One example of such a structure is shown in U.S. Pat. No. 4,676,293, assigned to the assignee of the present invention. In that patent, a sectional door is disclosed that includes a bottom panel having significant flexibility, thus allowing it to absorb impact However, if the impact is above a predetermined magnitude, the door is designed to allow the roller associated with the bottom-most panel to disengage from the panel, thus allowing the panel to swing free relative to the rest of the door. This action protects the bottom panel from damage.

The various breakaway mechanisms disclosed in the prior art may adequately perform the desired function, but may be limited in use to certain environments or types of doors. In other circumstances, the disclosed breakaway mechanisms may not adequately function. Even when they do function properly, however, reassembly or repair of such doors following breakaway may be a cumbersome or time-consuming process. Spare parts may need to be maintained on hand, and trained technicians may need to be called to reassemble the door following breakaway. Complex breakaway mechanisms may also significantly increase the costs associated with a given door.

SUMMARY OF THE INVENTION

Accordingly, it is the primary aim of the present invention to provide an improved releasing mechanism for industrial door as compared to those previously provided.

In accordance with that aim, it is an object of the invention to provide an industrial door release mechanism that provides simple construction and operation.

It is the further object of the invention to provide an industrial door release mechanism that allows for easy reassembly of the door following a breakaway condition.

A still further object is to provide an inexpensive and reliable release mechanism that may be used on a variety of industrial doors.

In accordance with these and other objects of the invention, there is provided an improved release mechanism for use in combination with an industrial door. The industrial door upon which the release mechanism may be used includes an extension member extending across the doorway opening when the door is in its doorway-blocking positions. The releasing mechanism associated with such an industrial door, and in accordance with this aspect of the present invention, includes a roller mounted for movement with the extension member. A track, extending along the doorway, also forms a portion of the releasing mechanism. The track includes a guideway for receiving the roller and guiding it during normal door operation. According to a significant aspect of the invention, the roller and track are movable relative to each other upon application of a breakaway force to the extension member. This relative movement between the roller and the track allows the roller to escape from the track when a breakaway force is applied to the extension member, the breakaway force being defined as a force that has a component perpendicular to the plane of the door above a certain magnitude.

In one embodiment of this broad invention, the track is coupled to a fixed member disposed adjacent the doorway opening. Between the fixed member and the track is a resilient member. The presence of the resilient member between the fixed member and the track allows the track to move relative to the roller when an impact is exerted on the extension member. That is, this impact is transmitted through the extension member and the roller to the track. The resilient member is then deformed and/or compressed by this force exerted on the track, thus allowing the track to move relative to the roller, and allowing the roller to escape from the track. Of course, this release of the roller from the track only occurs when a breakaway force having a component perpendicular to the plane of the door above a certain magnitude is exerted on the extension member.

According to a further significant aspect of the invention, an automatic refeed mechanism is provided for reinserting the roller into the track following a release of the roller from the track according to the aspect of the invention described above. The track is generally u-shaped and includes legs defining the u. At least one of the legs includes a notch or cut-out formed along the length of the track. Fixed adjacent this notch is a guide member. Following breakaway of a roller from the track, movement of the door toward an unblocking position moves the roller toward the guide member eventually causing engagement between the roller and the guide member, thus guiding the roller through the notch and back into the track.

In a further aspect of the invention, a releasing mechanism is provided for use with industrial doors, which are movable between blocking and unblocking positions relative to a doorway. The release mechanism associated therewith, and according to this aspect of the invention, comprises an extension member which extends across the doorway with the door in its doorway-blocking positions, the extension member including at least one lateral end portion. A track extends along the doorway, and includes a guideway for receiving and guiding the lateral end of the extension member as the member moves between doorway-blocking and doorway-unblocking positions. According to a significant aspect of the invention, the tack is movable relative to the lateral end portion in response to a breakaway force on the extension member, defined as having a component perpendicular to the door plane above a certain magnitude. This allows the lateral end portion to escape the guideway and separate from the track. Accordingly, the extension member is "broken away" from the track.

In a preferred embodiment of this aspect of the invention, the track is coupled to a fixed member, and a resilient member is disposed between the track and the fixed member. A breakaway force exerted on the extension member is transmitted to the track. This deforms the resilient member and allows the movement of the track relative to the lateral end portion of the member, thus providing the novel breakaway action.

The invention also encompasses a novel method for providing breakaway or release of an industrial door from an associated track A track is provided along a doorway, and a door is provided including an extension member having lateral end portions received within and guided by the track as the door moves between blocking and unblocking positions. In response to a breakaway force, the track moves to a position where it does not impede movement of the extension member in a direction perpendicular to the doorway plane.

The embodiments of the invention will be described herein in reference to the appended drawings, wherein:

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents as are included within the scope and spirit of the invention as defined by the appended claims.

Figure 2:
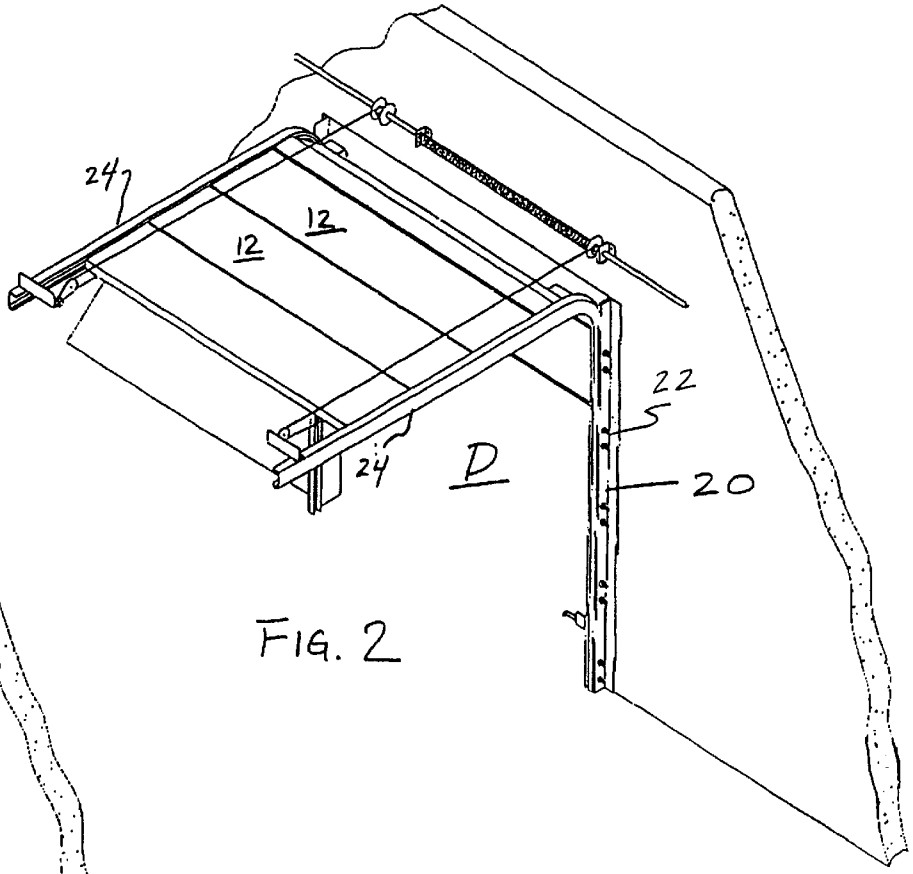
FIG. 2 is a perspective view of the industrial door of FIG. 1, and showing the door in an open position.
Figure 1:
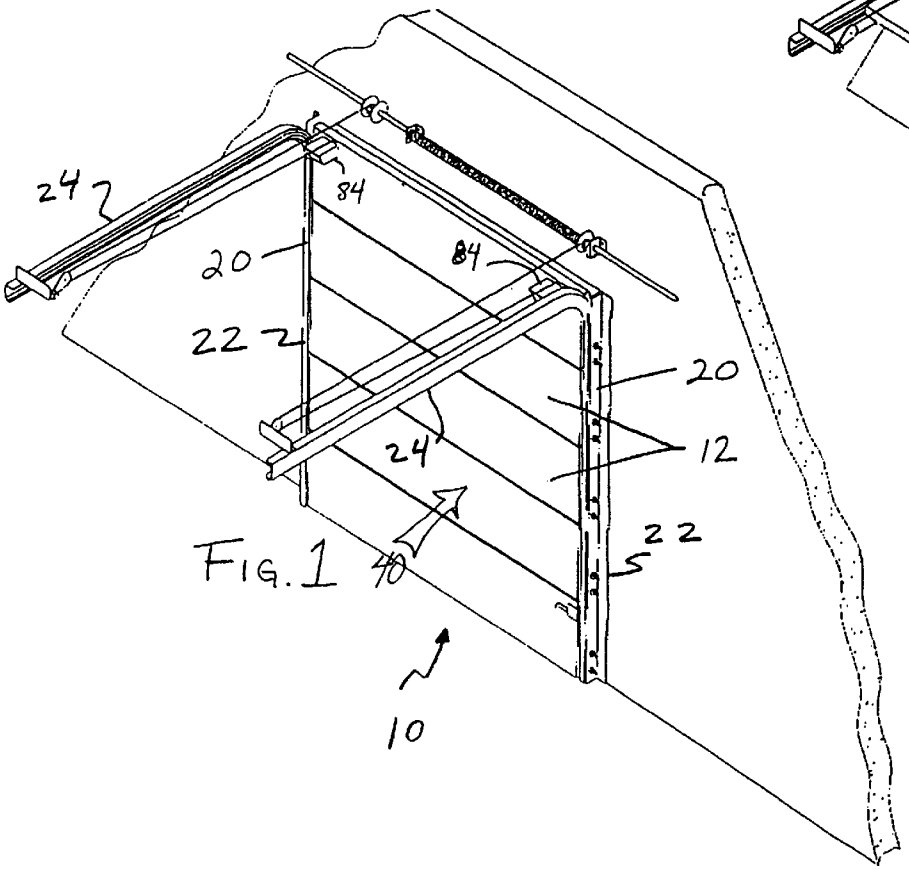
FIG. 1 is a perspective view of an industrial door embodying one aspect of the invention, and showing the door in a closed position.
Figure 3:
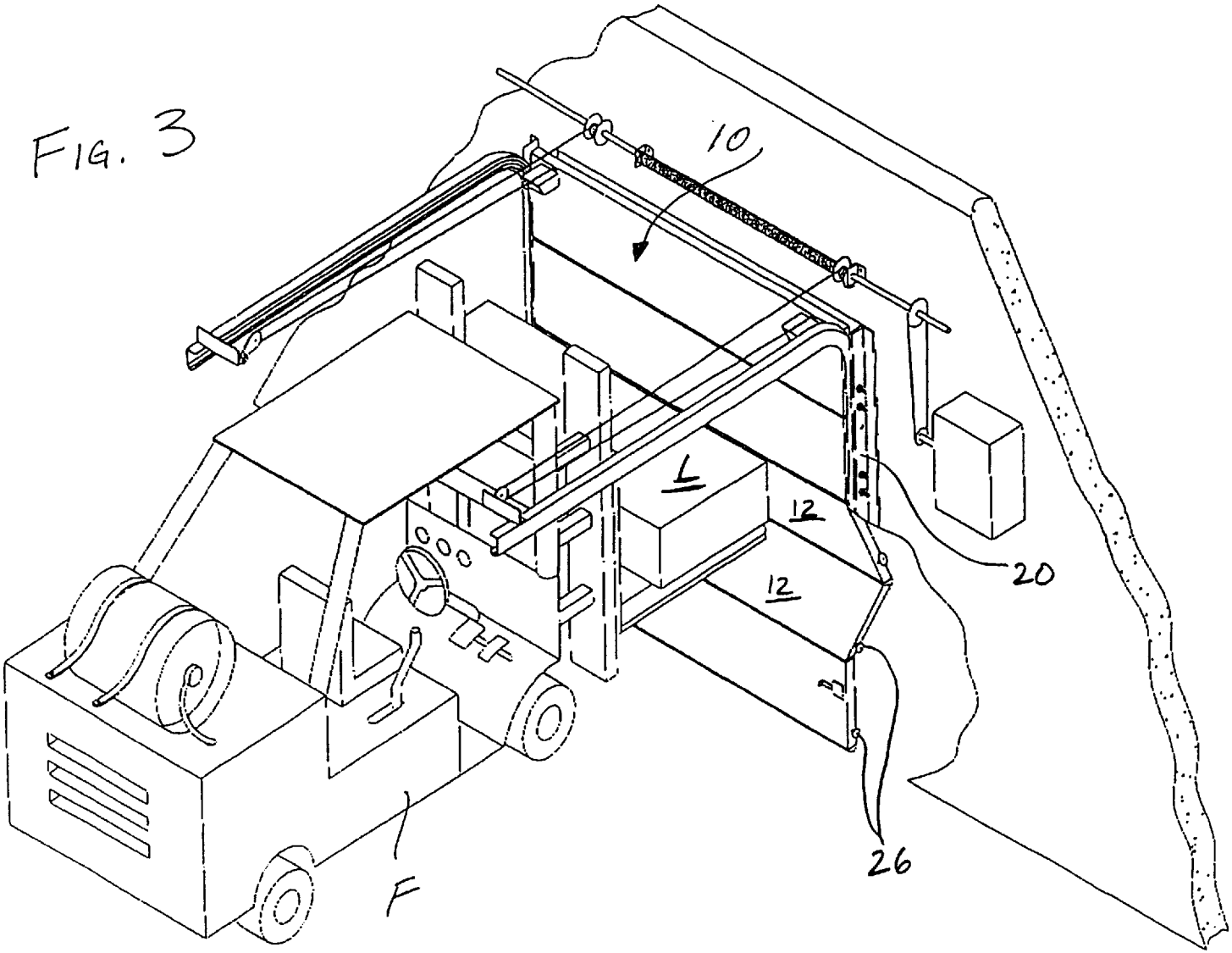
FIG. 3 is a perspective view of the door of FIGS. 1 and 2, showing the door releasing or breaking away for an applied force, according to an aspect of the invention.

An industrial door 10 according to the invention is shown in FIG. 1. The particular industrial door used for the illustrative embodiments of this invention is an overhead-type sectional door. This type of door typically includes a plurality of extension members in the form of panels 12 which extend across a doorway opening and are connected together by hinges (not shown). The door is movable between the door blocking position shown in FIG. 1, and a door open position (FIG. 2) in which the door 10 is not disposed over the doorway designated D in FIG. 2. It will be appreciated that the door 10 may still block at least a portion of doorway D at positions other than the fully closed position of FIG. 1. Accordingly, door 10 will be described as having a range of "doorway blocking" positions. In this embodiment of the invention, the door 10 is stored overhead in the doorway-open position of FIG. 2. Toward that end, the door includes a pair of tracks 20, each disposed on opposed sides of the doorway D. Each of the tracks 20 according to this embodiment includes two legs. The first leg of the track 22, extends along the doorway D. In this embodiment that means that first leg 22 extends vertically along the lateral edge of the doorway opening D. The second leg 24 of this track extends horizontally in an overhead position with respect to the doorway D. For a vertically storing door, both sections of track 20 would extend vertically. Coupling door 10 to the tracks 20 is a plurality of rollers 26, which cannot be seen in FIGS. 1 and 2 but which are shown in the section views of FIGS. 4–6. In this embodiment, a pair of rollers 26 are associated with each panel 12 of the door 10, a roller extending from each lateral edge of the panels 12 (FIG. 3). These rollers are received within guideways 28 forming a portion of the tracks 20. The guideways 28 may be integral with the track 20, as in the present embodiment, or may be separate members fixed to track 20. The guideways 28 can be seen in more detail in the cross section of FIGS. 4–6. In this embodiment, the guideway 28 is generally U-shaped, with the arms of the U being separated by slightly more than the diameter of the rollers 26. Door 10 is driven between the doorway blocking and doorway open positions by a conventional section door driving mechanism illustrated in FIGS. 1–3.

According to a significant aspect of the invention, the rollers 26 and the tracks 20 are designed to move relative to each other to provide for breakaway of the rollers from the tracks upon a breakaway force being exerted on the door. A typical impact exerting a breakaway force is illustrated in FIG. 3, showing a fork truck F with load L accidentally impacting door 10. Any of a wide variety of specific forces will cause the door 10 according to the invention to breakaway. However, since the driving mechanism that moves the door up and down necessarily causes relative vertical movement between the rollers 26 and the tracks 20, the door does not provide for breakaway in this direction. Rather, the door 10, according to the invention, is designed to breakaway for a force having a component perpendicular to the plane of the doorway (which is typically parallel to the plane of the door in the closed configuration). Clearly, then direct perpendicular blows to the door (assuming the force is above of predetermined magnitude) will cause breakaway. In addition, however, forces beside those being only in a direction perpendicular to the door can also cause breakaway. This may include, for example, glancing blows or blows exerted on the door at some angle. So long as the force has a component in the direction perpendicular to the plane of the door, and assuming that force is above a predetermined magnitude, breakaway will occur. Accordingly, such forces will be referred to herein as "breakaway forces"—if they have a component in the perpendicular direction above the predetermined magnitude. The door is designed to breakaway only above a certain predetermined magnitude of breakaway force to prevent the door from breaking away for only incidental contact. As will be described in greater detail below, various components of the door according to the invention can be selectively designed to provide a desired breakaway force.

Figures 4, 5, 6:
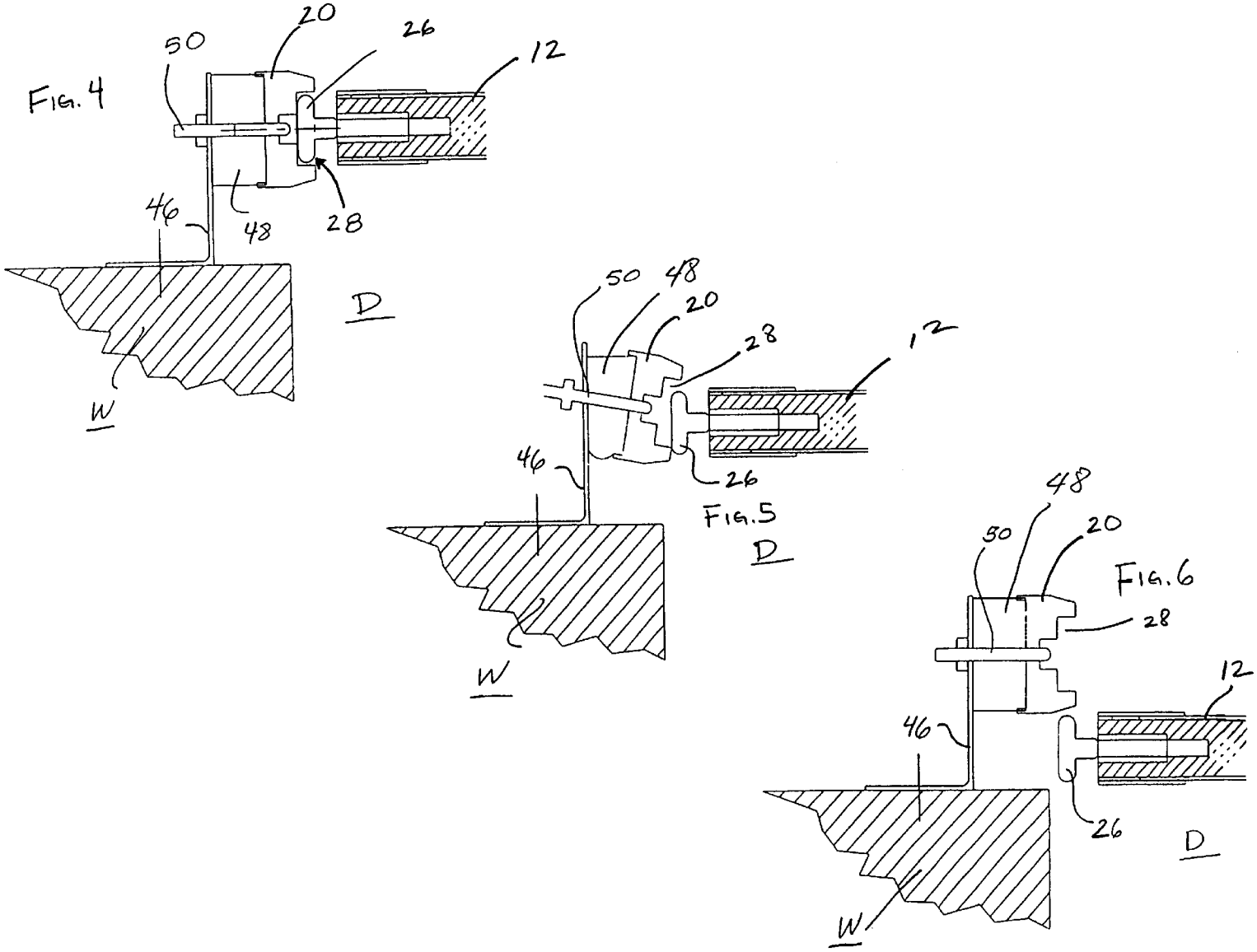
FIGS. 4–6 are a series of top section views showing the door of FIG. 1 in response to an applied breakaway force.

A first embodiment of this aspect of the invention, and showing structure providing for relative movement between the rollers 26 and the tracks 20 so as to allow the rollers 26 to escape from the tracks 20 upon a breakaway force, is detailed in the sectional view of FIGS. 4–6. According to this embodiment of the invention, the track 20 is coupled to a fixed member in the form of angle bracket 46 which is fixed to the wall W on one side of the doorway D. The coupling between the track 20 and the bracket member 46 will be discussed in greater detail below. To allow the track 20 to move relative to the roller 26 and thus to provide for escape of the roller 26 from the track 20 upon a breakaway force, a resilient member 48 is disposed between track 20 and bracket member 46.

The resilient member 48 is preferably formed of neoprene rubber, illustratively having a durometer of 55–65 on the Shore 00 scale. This material has the property of allowing the resilient member to be compressed and distorted by external forces, and yet retain its original shape once the force is removed. The presence of the resilient member 48 between the track 20 and the bracket member 46 allows the track 20 to move relative to the rollers 26 for a breakaway force. That is, the breakaway force is typically exerted on the panel 12, which forms an extension member which extends across the doorway. The breakaway force is then translated along the extension member 12 to the roller 26, and to the track 20 and its guideway 28. This force, as seen best in FIG. 5, is then translated to the resilient member 48 which, in response to this force, responsively deforms to allow the track 20 to move to a position where it does not impede movement of the roller 26 in a direction perpendicular to the plane of the door. Once the track 20 moves to this position, and assuming that the breakaway force is still being exerted on the extension member or panel 12, the panel 12 and attached roller 26 are now unimpeded (or less impeded) from moving in the direction perpendicular to the door plane, and the roller 26, and panel 12 to which it is attached, will now escape from the guideway 28 and move out of the plane of the doorway. By virtue of this breakaway, damage to either the panel, the roller, or the track is avoided or minimized.

The roller 26 and attached panel 12 are shown in the fully broken-away position in the section view of FIG. 6. Once the roller 26 and attached panel 12 have broken away, and the breakaway force is thus removed from the track 20 and resilient member 48, the resilient member 48 resumes its original shape, and track 20 is returned to its normal position. Thus, once the rollers 26 arc reinserted into the tracks 20, normal door operation can occur. A structure, according to the invention, for automatically achieving such reinsertion of the rollers is detailed below. In the absence of an automatic refeed mechanism, however, the present embodiment provides for simple reassembly of the broken-away door. Since the resilient member 48 is compressible and deformable, the track 20 can be moved manually (or with an appropriate tool) to a position where the roller 26 can be reinserted into track 20 by moving the panel or extension member 12 toward the track 20. FIG. 5 is an example of an orientation of track 20 that would allow for reassembly following breakaway.

Figure 8:
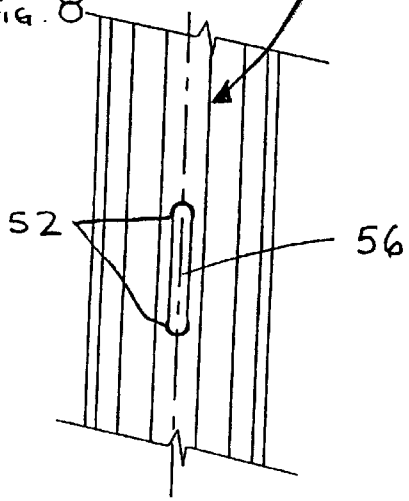
FIG. 8 is an inside elevation of a portion of the door of FIG. 1.
Figure 7:
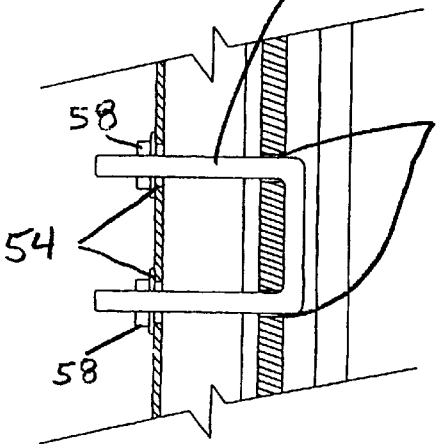
FIG. 7 is a side sectional view of a portion of the door of FIG. 1.
Figure 9:
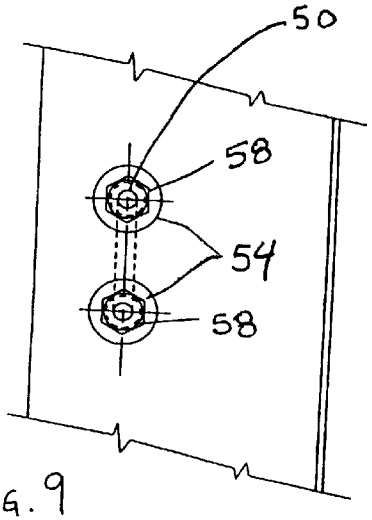
FIG. 9 is a rear elevation of a portion of the door of FIG. 1.

According to an aspect of the invention, track 20 is coupled to bracket member 46 by a "floating" coupling. This coupling maintains the track 20 in the proper vertical orientation, while also providing for limited horizontal motion of that leg 22. In this embodiment, the floating coupling is in the form of a series of U bolts connected between the track 20 and the bracket member 46. One such U bolt is shown in the side section view of FIG. 7. The U bolt 50 passes through a pair of spaced holes 52 in the track 20. The spaced holes 52 are seen most clearly in the elevational view of FIG. 8. The bail section 56 of the U bolt 50 is disposed between the spaced holes 52. Additionally, track 20 may include a grooved recess between the spaced holes 52 to allow the bail 56 of the U bolt 50 to be recessed into the face of the guideway 28. The opposite ends of the U bolt 50 pass through a pair of oversized holes 54 (relative to the diameter of the U bolt) on the bracket member 46, seen most clearly in the elevational view of FIG. 9. Accordingly, and as can be seen in the successive views of FIGS. 4–6, the track 20, while being coupled to the bracket member 46, is capable of limited horizontal movement, provided both by the free play of the U bolt 50 within the oversized holes 54 of the bracket member 46 and by the translation provided by deformation of the resilient member 48. This floating coupling between track 20 and the bracket member 46 enhances the relative motion between track and roller 26 provided for by the presence of the resilient member 48 between the bracket member 46 and the track 20. However, the door according to the invention does not require this combination, and would work adequately with a different type of coupling between the bracket member 46 and the track 20, provided that such coupling allowed for the relative movement between the track 20 and the roller 26 as provided by the deforming resilient member 48, as described above.

The door according to this embodiment of the invention will only provide the relative movement between the track 20 and rollers 26 so as to provide breakaway for a breakaway force defined as a force having a component perpendicular to the plane of the door, and above a certain magnitude. The predetermined magnitude of that perpendicular component can be modified in a variety of ways. For example, the durometer of the resilient member 48 can be changed to make the resilient member 48 either more or less stiff depending on the magnitude breakaway force desired In the alternative, or additionally, the position of nuts 58 on the U bolt 50 can either reduce or increase the separation between the bracket member 46 and the track 20. Increasing the distance would lessen the compressive force on the resilient member 48, and thus provide a lower breakaway force, while reducing this distance would pre-compress the resilient member 48, thus limiting the range of motion of the resilient member 48 and increasing the force required to provide for relative movement between the roller and the track 20, and thus to provide escape of the roller from the guideway 28. Further, although a single resilient member 48 has been shown, two or more individual resilient members, such as foam pads or springs, could also be used.

Figure 10:
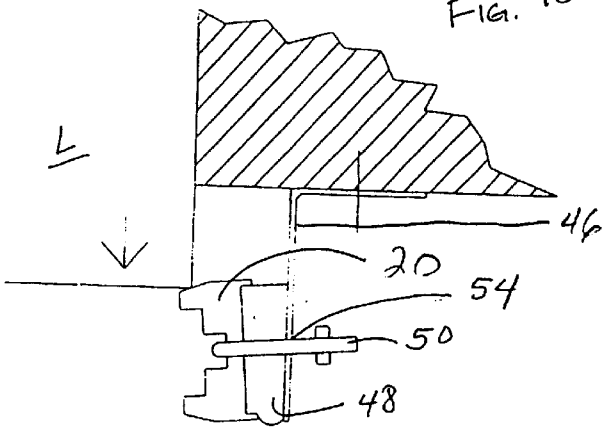
FIGS. 10–12 are a series of top section views showing the door of FIG. 1 responding to an impact on the tracks by an object.
Figure 11:
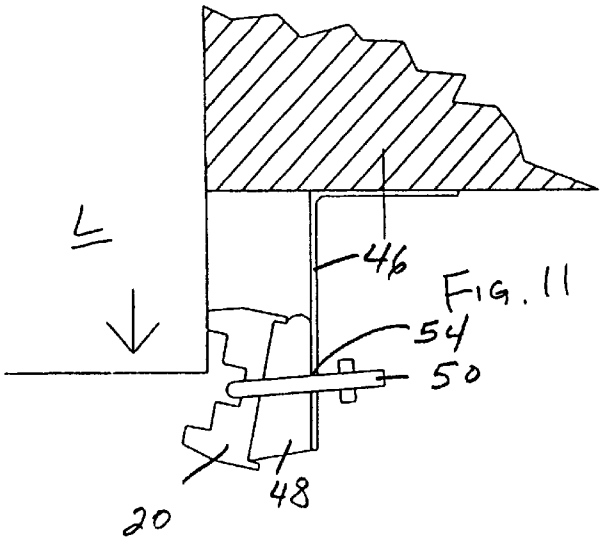
Figure 12:
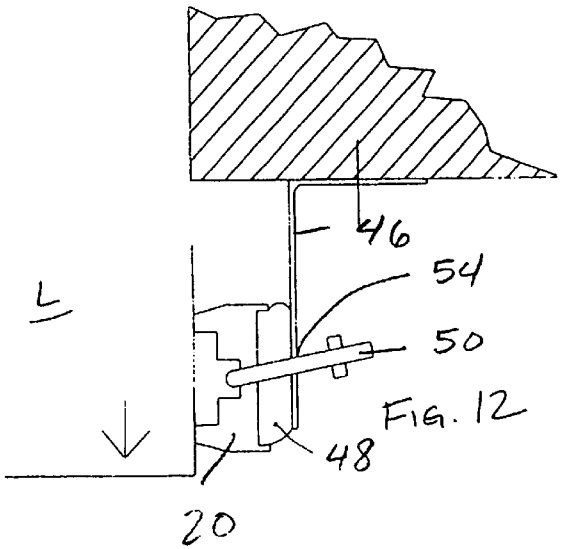

The presence of the resilient member 48 between the bracket member and track 20 also provides an additional advantageous feature. Since the roller 26, in this embodiment of the invention, is rigidly connected to the panel 12, the total width of the panel and attached roller or rollers 26 must be less than the width of the doorway D. Otherwise, upon breakaway, the rollers 26 and/or the panel 12 would strike the wall W in which the doorway D is formed. Since the width of the panel 12 and rollers 26 is thus less than the width of the doorway D, this also means that the tracks 20 must be disposed within the width of the doorway D. This is potentially problematic with the door 10 raised, since material handling vehicles passing through the doorway D could strike the tracks 20, potentially damaging them or limiting their lifetime. Fortunately, however, the resilient member 48, since it is deformable, will allow the track 20 to move out of the way of such a passing vehicle, or the load carried thereby, thus reducing or eliminating any damage to the track A schematic example of this action is shown in FIGS. 10–12. In FIG. 10, the corner of a load L, shown as having the same width as the doorway D (since the outer edge of load L is shown engaging the edge of the doorway D) is shown when it first makes contact with track 20. For a rigidly-disposed track 20, this contact would damage either the load or the track. However, by virtue of the compressible and deformable nature of the resilient member 48, illustratively in combination with the floating coupling provided by U bolt 50 and holes 54 in the bracket member 46, the track can be moved to a nonblocking position relative to the load L as shown in FIG. 11. FIG. 12 shows the load L further advanced, and a different compression state for the resilient member 48, as well as a different orientation for the U bolt 50 forming the floating coupling between track 20 and the bracket member 46. Importantly, FIG. 11 also shows that the floating coupling between the track 20 and the bracket member 46 allows not only horizontal motion of the track 20 perpendicular to the plane of the doorway in the sense of FIG. 12, but also allows the track 20 to float in a horizontal direction toward and away from the bracket member 46. This advantageous motion of the track 20 relative to the bracket member 46, as provided by the resilient member 48 and the floating coupling, reduces or eliminates damage to the track 20 by a wide load such as L in FIGS. 10–12.

While this embodiment of the invention has been described in conjunction with an overhead-storing sectional door, it is equally applicable to other types of doors. For example, a sectional door which stores above the opening would be nearly identical to the overhead-type storing door with the exception that the second leg of the track 20 would simply be disposed directly above the first section of the track 20. The invention could also be used in combination with fabric doors. As discussed above, such doors typically include either a bottom bar or wind bars which would form the extension members extending across the width of the door. In these doors, the bars form the extension members, rather than the individual panel as in a sectional-type door. Like panels in a sectional door, wind bars and bottom bars are relatively rigid members which extend across a doorway with the door in doorway-blocking positions. The rollers of the embodiment would then be disposed in the ends of either the wind bar or the bottom bar, and a track would extend along the doorway in a similar fashion to the track 20 in the disclosed embodiment. For a breakaway force on one or several of the bars, breakaway would be provided by that section of track being movable relative to the rollers by virtue of a resilient member such as resilient member 48 disposed between the track 20 and a bracket member 46. Other similar modifications of the invention for use in combination with other types of industrial doors will be apparent to one of skill in the art. In addition, while this embodiment has been described in conjunction with doors that roll up and down vertically, the invention could be equally applicable to horizontally disposed and moving doors. Further, it should be appreciated that a breakaway force exerted on an extension member (panels 12 or bottom bars/wind bars on roll-up doors) need not be exerted directly on the member itself Depending on the structure of the door, an impact or other force on a different part of the door could be translated to a given extension member by the structure of the door itself. Thus, a "breakaway force" on an extension member may be either directly or indirectly applied. Further still, it should also be appreciated that the breakaway or release mechanic provides for breakaway in both directions perpendicular to the plane of the doorway (into and out of the doorway).

Figure 27:
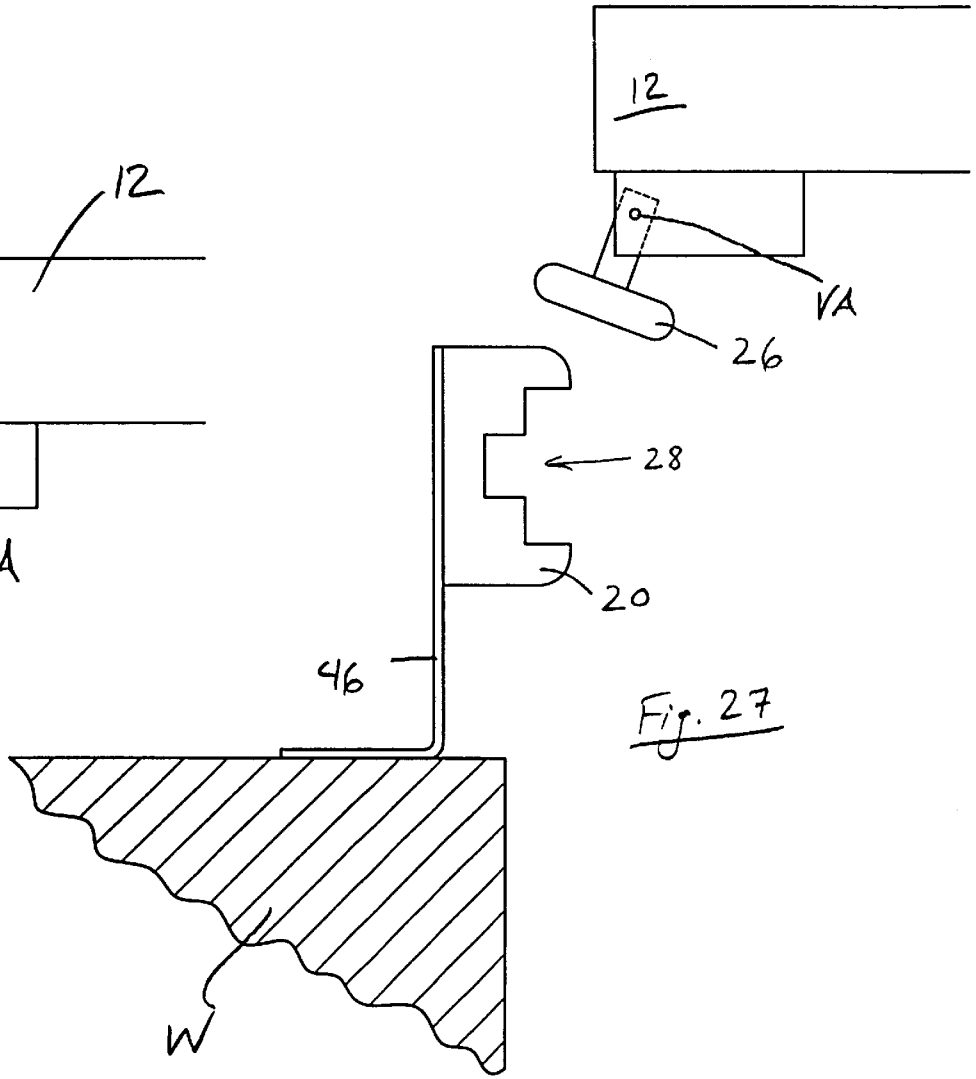
FIG. 27 is a view of the door in FIG. 26 showing the door releasing or breaking away for an applied force.
Figure 26:
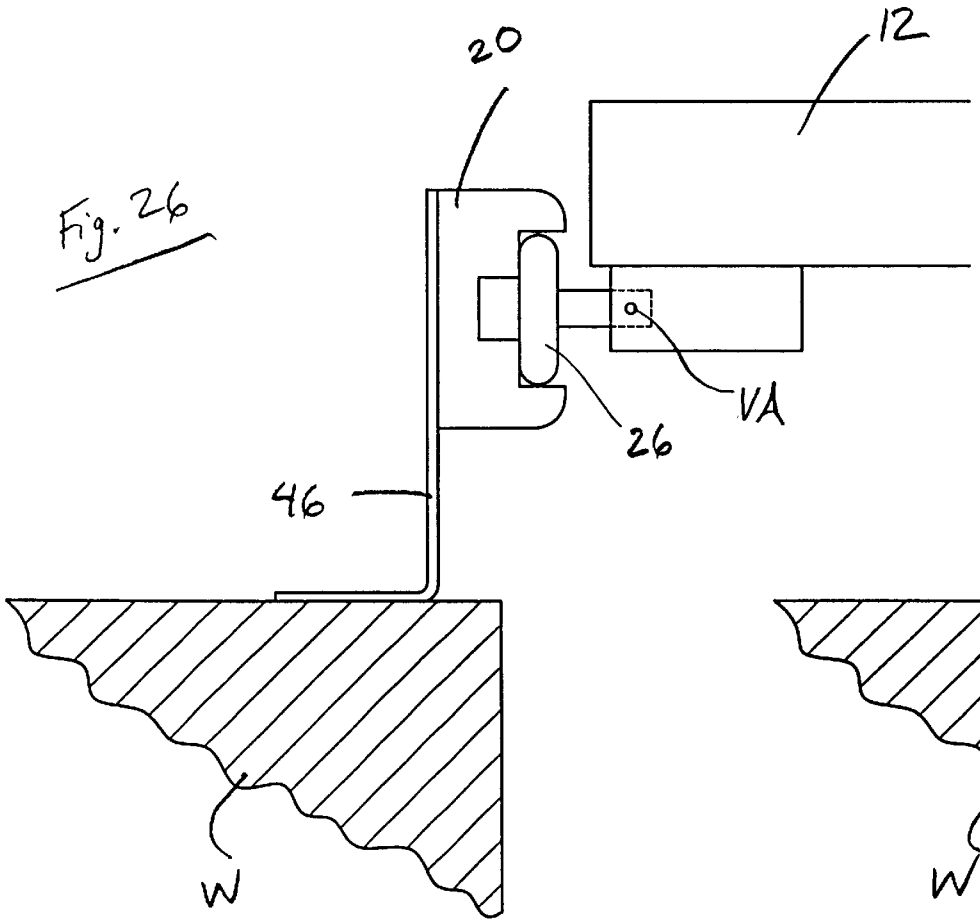
FIG. 26 is a door including a breakaway or release mechanism according to an alternative embodiment of the invention.

Nor is this aspect of the invention limited to the specific breakaway embodiment shown in FIGS. 1–12. On the contrary, alternative embodiments, providing relative movement between rollers 26 and track 20 for a breakaway force, also fall within the scope of the invention. For example, the relative movement between the roller and the track, which provides for escape of the roller from the track upon application of a breakaway force to the extension member extending across the door, could be provided by the roller being pivotally attached to the extension member about an axis disposed in the plane of the door in the closed position (i.e., a vertical axis for the door of FIGS. 1–12). Such an arrangement is shown in the drawings at FIGS. 26–27, with the door shown in normal operation and broken-away, respectively. Roller 26 is pivotally mounted to panel 12 about a vertical axis VA and is disposed within track 20 (FIG. 26) for normal door operation. For a breakaway force, roller 26 can rotate about axis VA to allow the roller 26 to escape from the guideway 28 of the track 20 as in FIG. 27. In such an embodiment, the track could preferably be designed to be immobile, as is shown in Fog. 26 with the track 20 coupled directly to the bracket 46". Further, since the rollers would fold out of the plane of the doorway on impact, the tracks could be placed at a width greater than the width of the doorway. Such placement would reduce the possibility of the track being impacted by a vehicle or its load. Further alternative means for providing relative movement between rollers disposed at the ends of extension members, and associated tracks, and which thus fall within the scope of this invention, will occur to those of skill in the art.

Figure 16:
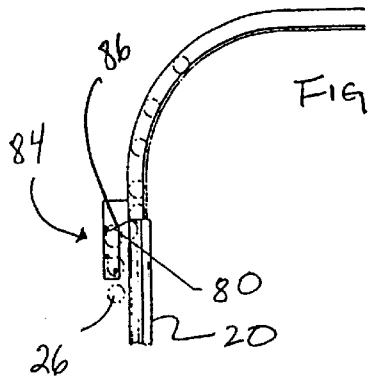
FIG. 16 is a side section view of the refeed mechanism illustrated in FIGS. 13–15.
Figure 15:
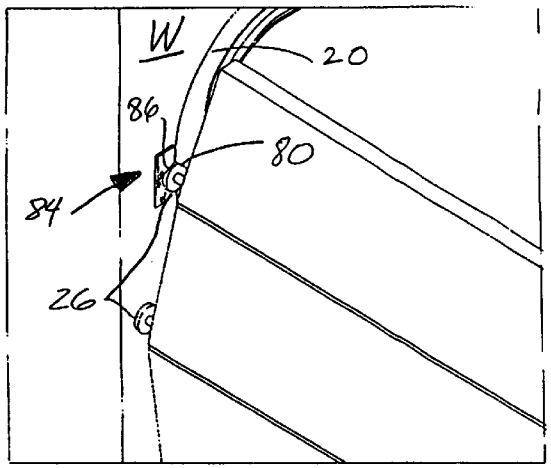
FIGS. 13–15 are a series of perspective views of a refeed mechanism for an industrial door according to an aspect of the invention.
Figure 14:
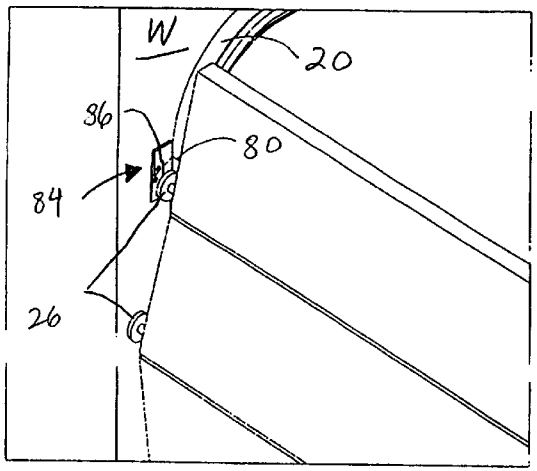
Figure 13:
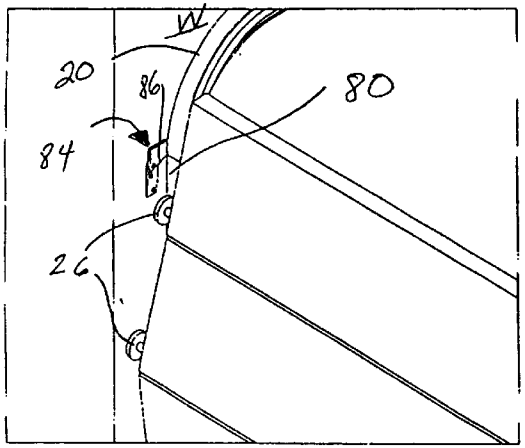

A further aspect of the present invention is an automatic refeeding mechanism, for returning the rollers to the tack following breakaway. An embodiment of the automatic refeed mechanism according to this aspect of the invention can be seen with reference to FIGS. 13–16. The refeed mechanism takes advantage of the movement of the door between doorway-blocking and doorway-unblocking positions to guide the broken away rollers 26 back into the track 20 through a notch or break in the track 20. As can be seen in the top section view of FIG. 4, the track 20, and its integral guideway are u-shaped in cross-section. The notch in the track 20, that provides for refeed according to this embodiment of the invention is formed in at least one leg of the u-shaped track, and can be seen in the perspective view of FIG. 13 bearing reference numeral 80. To ensure that a broken away roller 26 reenters the track 20 as the roller moves toward the doorway-unblocking position, the refeed mechanism, according to the invention, also includes a guide member 84 disposed adjacent the track notch 80. In the present embodiment, the guide member is attached to the track 20. The guide member 84 is disposed to be in the path of travel of the broken away roller 26 as it approaches the notch 80. The engagement of the roller 26 with the guide member 84 guides the roller to the notch 80, causing the roller to reenter the guideway 28 of the rack 20 for continued movement of the door to a doorway unblocking position. In the present embodiment, the guide member 84 includes an angled camming surface 86 which guides and translates the roller 26 to the notch 80 for upward movement of the door upon engagement of the roller with the surface 86. FIGS. 13–15 sequentially show a broken-away roller approaching the guide member 84, engaging the member 84 (causing the roller 26 to be guided toward the notch 80), and entering the notch 80, thus refeeding roller 26 into the guideway of the track 20. FIG. 16, shows a similar action from a side section view, but with subsequent positions of the roller being shown in phantom. Of course, an automatic refeed mechanism according to the invention will preferably be disposed on both lateral sides of the door 10, as can be seen in FIG. 1.

While the automatic refeed mechanism according to the invention has been shown in a representative embodiment in the Figures, the invention is not so limited. For example, guide member 84 has been shown attached to the track 20 in FIGS. 13–15, but other mountings of the member 84 adjacent to the notch 80 are possible, including attachment of the member 84 to the wall W. Further, the refeed mechanism has only been shown on the side of the door closest to the doorway D for an overhead-storing sectional door. For the case of a vertically-stored sectional door, such a refeed mechanism could be disposed on both sides of the door. Various other alternatives for roll-up and other types of industrial doors are also possible.

An alternative embodiment of the automatic refeed mechanism is shown in FIGS. 17 through 24. According to this embodiment, the guide member 84 from the previous embodiment is in the form of two separate guide members 84*a* and 84*b*. The first guide member (84*a*) is to translate a refeeding roller 26 that has become misaligned in a lateral direction to ensure that it will reenter the notch 80. The other portion of the guide member (84*b*) is designed to direct and translate the roller 26 through the notch 80. To prevent a roller properly engaged within the track 20 from accidentally exiting the track 20 through the notch 80, this embodiment also includes a notch cover 85, which normally covers the notch 80 in the track 20, but which is pushed open by a properly refeeding roller 26.

Figure 18:
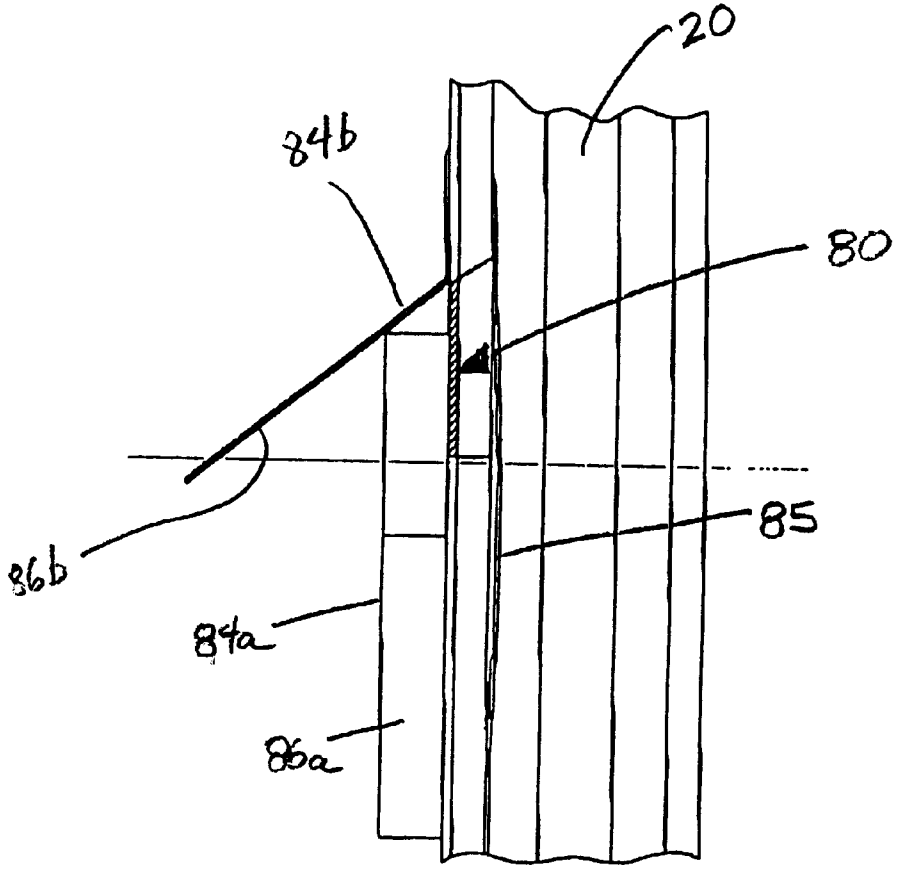
FIG. 18 is a side elevational view of the refeed mechanism of FIG. 17.
Figure 17:
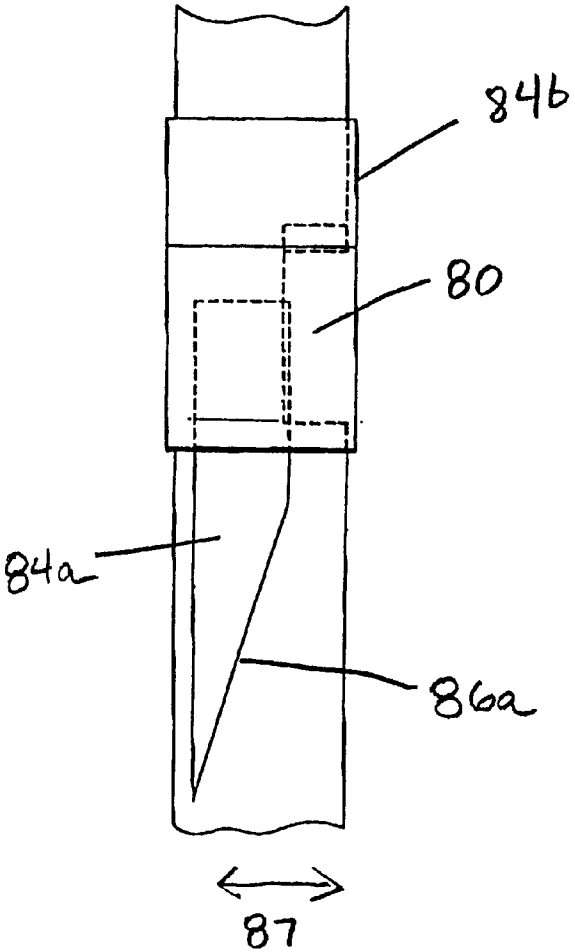
FIG. 17 is a front elevational view of an alternative embodiment of the refeed mechanism according to the invention.

The two portions 84*a* and 84*b* comprising the guide member according to this embodiment of the invention can be seen most clearly in the elevational views of FIGS. 17 and 18. Lateral guide member 84*a* includes an angled surface 86*a* which would guide a broken-away roller 26 that had become misaligned in a lateral direction (indicated by the arrow 87 in FIG. 17). Thus, surface 86*a* ensures that the roller 26 is properly aligned with the notch 80 during refeed. The second guide member 84*b,* according to this embodiment of the invention, and is seen most clearly in FIG. 18, is an angled member attached to the face of guide track 20 at a position slightly above that of the notch 80. In the present embodiment, the angled member 84*b* is a piece of spring steel. Member 84*b* includes an angled surface 86*b* which guides a broken-away and properly aligned (by means of first guide member 84*a*) roller back into the track 20 through notch 80.

According to a further aspect of the invention, notch door 85 is associated with the notch 80. The purpose of the notch door is to prevent a roller that is properly within the track 20 from accidentally escaping from the track 20 through the notch 80. Accordingly, the notch door 85 covers the notch 80 in all situations except the situation when a refeeding roller is guided into the notch 80 by the guide member 86*b*. To provide for this function, the notch door, according to this aspect of the invention, is simply a piece of spring steel 85 attached to the inside edge of the side wall of the track 20 associated with the notch 80. Of course, if both side walls of the track 20 include a refeed mechanism according to the invention, a notch door 85 would be associated with each notch 80. The spring steel of the notch door 85 is biased to normally cover notch 80. However, upon an applied force by a refeeding roller 26, notch door 85 will move away from a covering position with respect to the notch 80, and allow the roller 26 to re-enter the guide track 20.

Figure 21:
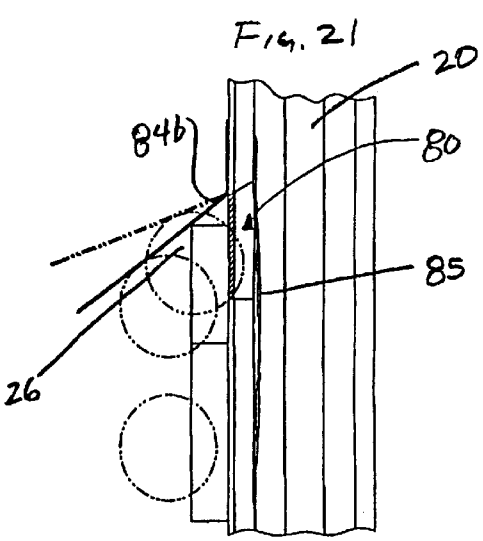
FIGS. 19–24 are a series of operational side elevations, showing the operation of the refeed mechanism of FIG. 17.
Figure 20:
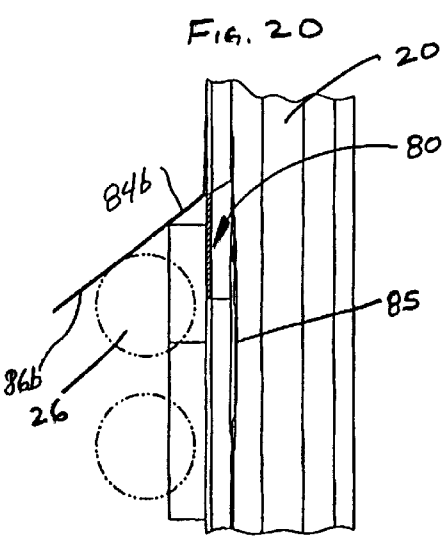
Figure 19:
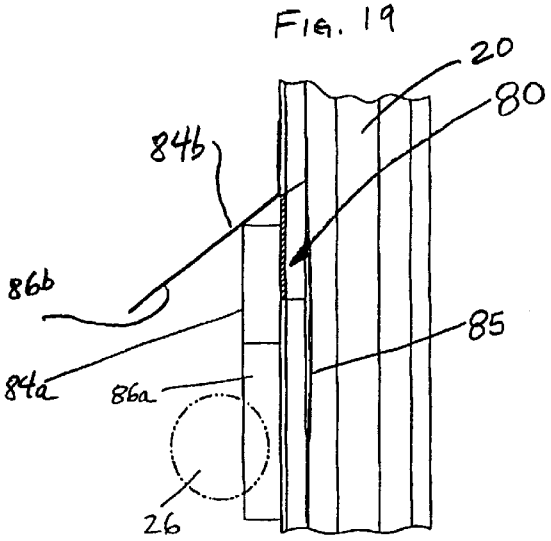
Figure 24:
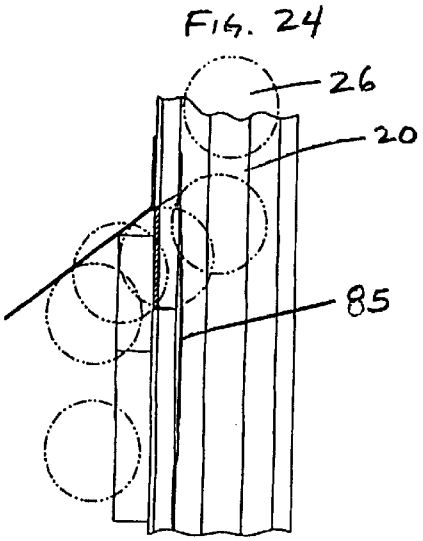
Figure 23:
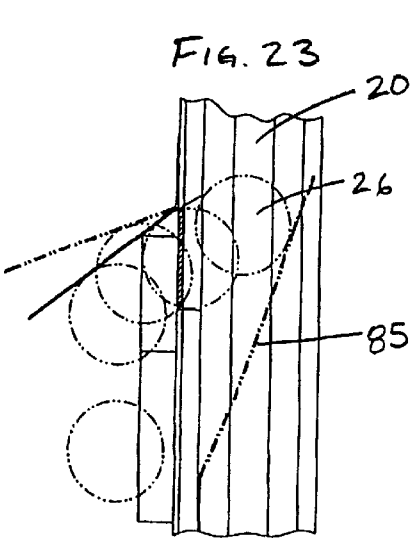
Figure 22:
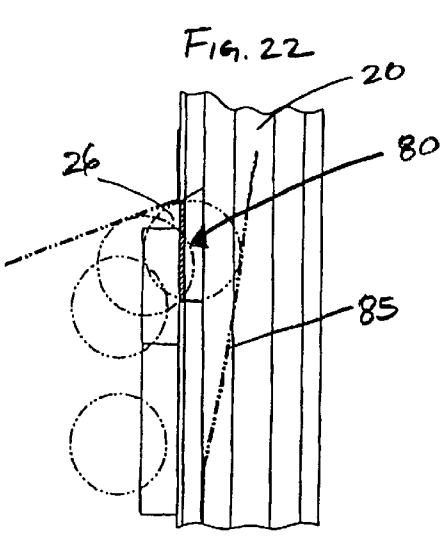

A sequence of operation for the refeed mechanism according to this aspect of the invention is shown in FIGS. 19–24. FIG. 19 shows a refeeding roller 26 approaching the notch 80. In FIG. 19, roller 26 is shown engaging angled surface 86*a* of the first guide member 84*a*. If the roller is misaligned in a lateral direction, guide surface 86*a* will realign it with notch 80. FIG. 20 shows the roller further advanced and engaging angled surface 86*b* of the second guide member 84*b*. Similarly, FIG. 21 shows the roller slightly further advanced, it having pushed the spring steel member 84*b* such that the angled surface 86*b* is slightly raised. The leading edge of the roller 26 is also shown entering notch 80 in FIG. 21. FIG. 22 shows the roller continuing upward and inward as it is refed into the track 20, and showing roller 26 pushing against an opening notch door 85. Thus, the force of the refeeding roller was sufficient to overcome the bias force on notch door 85 which normally holds notch door 85 in position over the notch 80 in the guide track 20. FIG. 23 simply shows further progression of the roller 26 such as it is now fully engaged within the guide track 20, the notch door 85 being displaced its greatest amount. Finally, FIG. 24 shows the roller 26 continuing upward within the guide track. Since roller 26 is no longer in engagement with notch door 85, the spring bias of the spring steel forming notch door 85 has returned it to its normal closed position with respect to the notch 80.

According to this aspect of the invention, the guide member for guiding a broken-away roller 26 back into the guide track 20 comprises both a lateral guide member 84*a* and a horizontal guide member 84*b* for guiding the roller back into the notch 80. Also included is a notch door 85 which is disposed to normally cover the notch 80, but which may be engaged by the roller 26 to expose the notch and allow the roller 26 to re-enter guide track 20.

Figure 25:
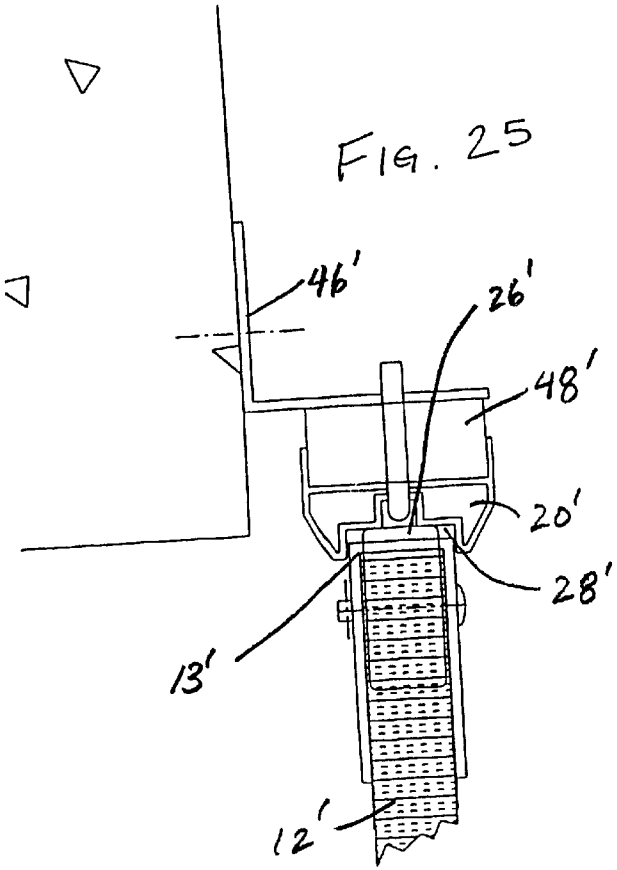
FIG. 25 is a door including a breakaway or release mechanism according to an alternative embodiment of the invention.

A further aspect of the invention which provides for breakaway of an industrial door upon application of a breakaway force to the door, is illustrated in the embodiment of FIG. 25. Similar reference numerals to the previous embodiments will be indicated in reference to FIG. 25 with a prime (′). FIG. 25 shows a sectional door in which the extension member or panel 12′ extends into the track 20′. That is, a lateral end portion 13′ of the panel 12′ is received within and guided by the guideway 28′ of the track 20′ as the door moves between doorway blocking and doorway unblocking positions. To reduce friction, rollers 26′ may also be included in the lateral end portions, although they are not required Rollers 26′, if used, are oriented about horizontal axes perpendicular to the plane of the doorway, as opposed to axes parallel to the plane of the doorway as in the embodiment of FIGS. 1–12.

The present embodiment provides for breakaway by virtue of the track 20′ moving relative to the lateral end portions 13′ for application of a breakaway force to the extension member or panel 12′. As in the previous embodiment, the track 20′ is preferably coupled to a fixed member in the form of a bracket member 46′, and a resilient member 48′ is preferably disposed between the track 20′ and the bracket member 46′. The deformability of the resilient member 48′ for a breakaway force applied to the extension member 12′ and transmitted to member 48′ allows the track 20′ to move to a position where it does not impede movement of the panel 12′ in a direction perpendicular to the plane of the doorway. The lateral end portions 13′ of the panel 12′ thus escape from the guideway 28′ of the track 20′ allowing the panel 12′ to breakaway. It should be noted that the embodiment shown in FIGS. 1–12 also achieves breakaway in the same manner if the rollers 26 are associated with the lateral end portions 13′ of the present embodiment.

The different embodiments of a release mechanism for an industrial door, as just described, provide a unique method for allowing the breakaway of a door from its associated track. According to that method, a track is provided along a doorway, and a door is provided which includes extension members having lateral edges received within and guided by the track as the door moves between doorway blocking and doorway unblocking positions. In response to a breakaway force applied to an extension member, the track is moved to a position where it does not impede movement of the extension member in a direction perpendicular to the plane of the doorway. According to the method of the invention, the extension member may either be provided with a lateral end portion forming a continuation of the extension member itself, or it may be provided with a lateral end portion in the form of a roller. In either event, the relative movement of the track for a breakaway force allows the breakaway action. In the preferred embodiment of this invention, the movement of the track to a position that allows the lateral edge to escape is provided by transmitting the breakaway force to a resilient member disposed between the track and a fixed member, and by compressing and deforming the resilient member, thus allowing the track to move.

There has thus been provided a novel breakaway or release mechanism for an industrial door, as well as an automatic refeed mechanism and a method for providing such breakaway. In a door using breakaway according to the invention, damage to the door as well as the associated track or sideframe is minimized for an impact on the door. The source of that impact, such as a forktruck will also exhibit minimized damage as compared to prior art breakaway systems. While the foregoing illustrative embodiments of the invention represent the best mode presently contemplated for carrying out the invention, these embodiments are in no way restrictive of the scope of the invention. Rather, the invention is intended to cover all modifications and equivalents of these and other embodiments as fall within the spirit and scope of the appended claims.

What is claimed is:

1. An impactable track assembly for a sectional door, the sectional door generally defining a plane when disposed in a closed position relative to an associated doorway and including panels and at least one roller associated with one of said panels, the assembly comprising:

a track including a guideway adapted to receive and guide the at least one roller when the track is in a first orientation;

a fixed member to which the track is coupled; and a separate resilient member disposed between the track and the fixed member; the track being movable away from the first orientation and relative to the fixed member in a direction perpendicular to the plane in response to a force applied to the track having a component perpendicular to the plane and returnable to the first orientation by the action of the resilient member once the applied force is removed.

2. The impactable track assembly of claim 1, wherein the resilient member provides for movement of the track relative to the fixed member by being deformed in response to the force applied to the track.

3. The impactable track assembly of claim 2, wherein the deformation of the resilient member is compression thereof.

4. The impactable track assembly of claim 1, wherein the resilient member is comprised of rubber.

5. The impactable track assembly of claim 1, wherein a floating coupling is provided between the track and fixed member.

6. The impactable track assembly of claim 1, wherein the track is generally u-shaped in cross-section and includes straight sidewalls defining the guideway.

7. An impactable track assembly for a sectional door including panels and at least one roller associated with one of said panels, the assembly comprising:

a track assembly including a guideway adapted to receive and guide the at least one roller when the track assembly is in a first orientation;

a fixed member to which the track assembly is coupled the fixed member having a generally planar first surface; and a separate resilient member coupling the track assembly and the fixed member and being disposed entirely to one side of the first surface; the track assembly being movable away from the first orientation and relative to the fixed member in response to a force applied to the track assembly and returnable to the first orientation by the action of the resilient member once the applied force is removed;

wherein the fixed member does not extend perpendicularly beyond the first surface in a direction toward the resilient member.

* * * * *